US009194660B2

(12) United States Patent
Crye et al.

(10) Patent No.: US 9,194,660 B2
(45) Date of Patent: Nov. 24, 2015

(54) ATTACHABLE ARMORED GARMENT

(71) Applicants: Caleb Clark Crye, Brooklyn, NY (US); Matthew Aaron Johnson, Milford, PA (US)

(72) Inventors: Caleb Clark Crye, Brooklyn, NY (US); Matthew Aaron Johnson, Milford, PA (US)

(73) Assignee: LINEWEIGHT LLC, Brooklyn, NY (US)

( * ) Notice: Subject to any disclaimer, the term of this patent is extended or adjusted under 35 U.S.C. 154(b) by 42 days.

(21) Appl. No.: 14/152,651

(22) Filed: Jan. 10, 2014

(65) Prior Publication Data

US 2015/0198422 A1 Jul. 16, 2015

(51) Int. Cl.
*F41H 1/02* (2006.01)

(52) U.S. Cl.
CPC ..... *F41H 1/02* (2013.01)

(58) Field of Classification Search
CPC ..... F41H 1/02; A41D 13/0518; A41D 1/04; A41D 27/04
USPC ..... 2/2.5, 463, 92, 97, 102; 89/36.01, 89/36.02, 36.05
See application file for complete search history.

(56) References Cited

U.S. PATENT DOCUMENTS 4,590,622 A * 5/1986 Wolfe et al. ..... 2/462
5,044,011 A 9/1991 Henderson
5,060,314 A * 10/1991 Lewis ..... 2/2.5
5,685,015 A * 11/1997 Aldridge ..... 2/81
5,970,513 A 10/1999 Kocher
D476,138 S 6/2003 Leahy et al.
7,937,780 B2 5/2011 Matic et al.
7,992,221 B2 8/2011 Sonner
8,347,422 B2 1/2013 Kalaam et al.
8,528,112 B2 * 9/2013 Blauer et al. ..... 2/2.5
2008/0134419 A1 6/2008 Kalaam et al.
2012/0159680 A1 6/2012 Howland
2012/0324612 A1 12/2012 Howell et al.

FOREIGN PATENT DOCUMENTS

WO 2006/096981 A1 * 9/2006 ..... F41H 1/02

OTHER PUBLICATIONS

"HALFJAC ™" p. 9, Crye Precision 2013 Product Guide, 2013.

* cited by examiner

*Primary Examiner* — Tejash Patel
(74) *Attorney, Agent, or Firm* — Stiennon & Stiennon

(57) ABSTRACT

A ballistic protection garment assembly has a two sleeves joined by front and back yolks. The sleeved garment can be attached to a variety of ballistic vests with front and rear attachment assemblies which are removably connected to the yolks by zippers. For ballistic vests with appropriate patches of hook and look fastener material, the attachment assemblies comprise mating hook and loop fastener material. For ballistic vests with webbing sewn in the U.S. Army's PALS (Pouch Attachment Ladder System) arrangement, the attachment assemblies comprise a panel with connected straps which are extended through loops of the vest webbing, and held in place by buckles and C-shaped retaining elements.

11 Claims, 3 Drawing Sheets

ATTACHABLE ARMORED GARMENT

BACKGROUND

The present invention relates to armored clothing in general, such as armored garments which cover the wearer's arms, and are readily attached and detached from vests.

When a police officer enters a hallway or room, the first part of his body that may become exposed is the forearm and shoulder. Without protection in this area, gunshot injuries are a serious risk. Separate armor components for most body extremities are known, but it can be a time consuming process to individually attach protective elements for each extremity. In many applications, the police officer or soldier will not want to wear full armor throughout the day, yet it is important that the extra armor be readily and speedily attached when the need arises. What is needed is convenient armor that can be attached in little time.

SUMMARY

The invention includes armored sleeves that can be selectively integrated with a ballistic vest to form a full ballistic jacket. The garment has two sleeves joined by front and back yolks. The sleeved garment can be attached to a variety of ballistic vests with front and rear attachment assemblies which are removably connected to the yolks by zippers. For ballistic vests with appropriate patches of hook and loop fastener material, the attachment assemblies comprise mating hook and loop fastener material. For ballistic vests with webbing, such as webbing sewn in the U.S. Army's PALS (Pouch Attachment Ladder System) arrangement, the attachment assemblies comprise a panel with connected straps which are extended through loops of the vest webbing, and held in place by fasteners such as buckles and C-shaped retaining elements.

DESCRIPTION OF THE PREFERRED EMBODIMENTS

Figure 1:
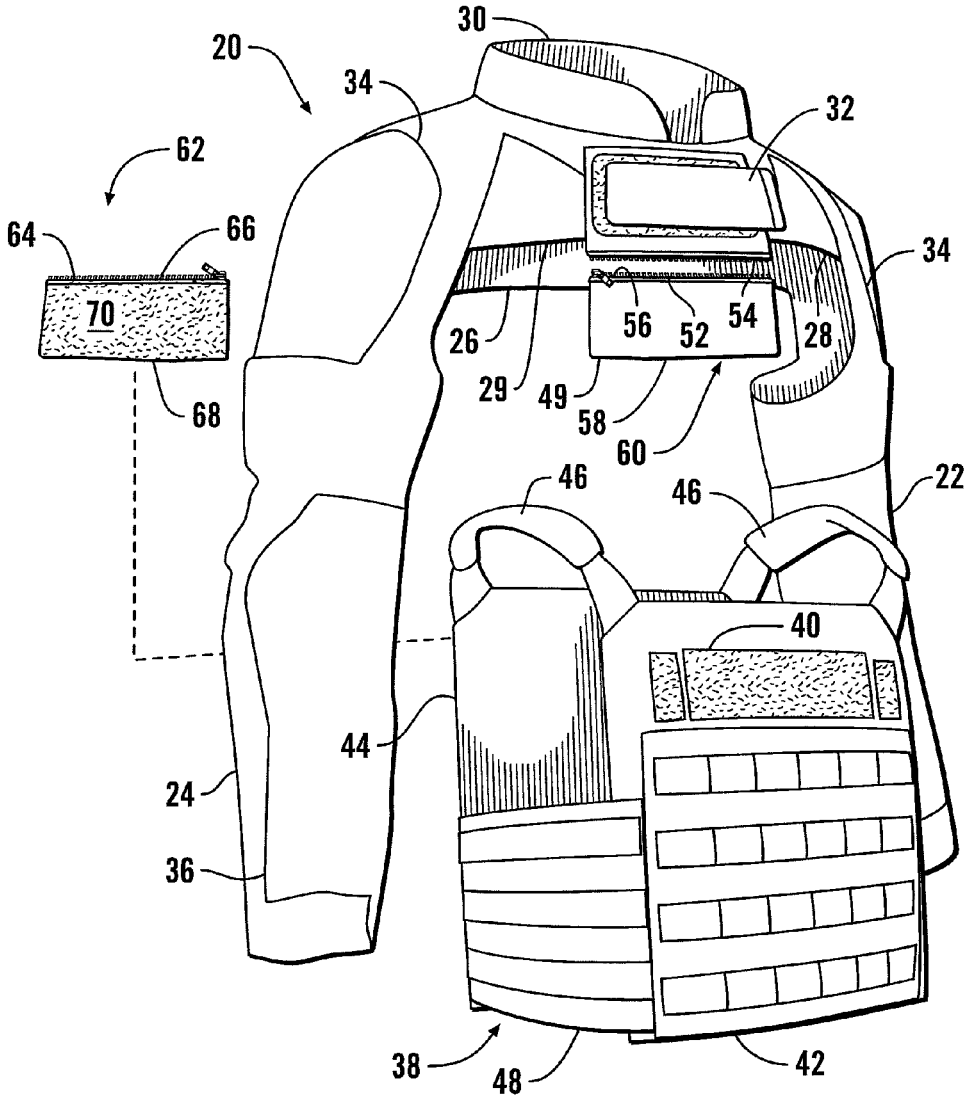
FIG. 1 is an exploded perspective view of an armored garment assembly showing a sleeve module in relation to a vest.

Referring more particularly to FIGS. 1-4, wherein like numbers refer to similar parts, an armored sleeve assembly 20 is shown in FIG. 1. The sleeve assembly 20 has a left sleeve 22 and a right sleeve 24 which are joined by a rear yoke 26 and two overlapping front yoke segments 28, 29. The sleeve assembly may have a protruding collar 30 which extends upwardly around a neck opening. The front yoke segments 28, 29 are connected by a closure flap 32 on the right front yoke segment 28 which a first part of a hook and loop fastener, and which engages with the other part of the hook and loop fastener on the left front yoke segment 28, in this way, the two front yoke segments and closure flap releasably fasten the first sleeve to the second sleeve to retain the garment on a wearer.

Each sleeve has a shoulder pocket 34 which receives a shoulder ballistic armor element (not shown), and a forearm pocket 36 which receives a forearm ballistic element (not shown). By "ballistic element" is meant an element of soft or hard armor, configured to resist ballistic projectiles or fragments, namely bullets and shrapnel. A soft armor ballistic element may include assemblies of ballistic fabric such as those formed from DuPont Kevlar® para-aramid synthetic fibers, fibers of Spectra® ultra high molecular weight polyethylene fibers from Honeywell, or other ballistic material. The hard armor ballistic elements may be, for example, fabricated of rigid plates of ceramic, polymer, or metal.

Although capable of being worn by itself, the sleeve assembly 20 is configured to be rapidly and conveniently attached to or removed from a ballistic vest 38. The vest 38 may be provided with various mechanisms for receiving attachments and accessories. One attachment system employed by US military services is the U.S. Army's PALS (Pouch Attachment Ladder System) arrangement. This system can be provided on a belt or a vest, and employs horizontal rows of 1" Mil-W-43668 Type III nylon webbing spaced 1" apart, and attached to a backing fabric panel at 1.5" intervals. The PALS webbing defines an array of upwardly and downwardly opening loops. Pouches, pockets, holsters, and other accessories may be attached to the loops. Commonly, the PALS system is a component of a supporting vest such as those which are a part of the US Army's *MOLLE* (MOdular Lightweight Load-carrying Equipment) system.

The vest 38 has a front panel 42 joined to a rear panel 44 by two shoulder straps 46 and two side panels 48. Front and back patches 40 of a first part of a hook and loop fastener, such as the VELCRO® hook and loop fastener made by Velcro Industries B.V., are secured to the upper portions of the vest front panel 42 and the vest rear panel 44. The sleeve assembly 20 has a front attachment assembly 49 which includes a front mounting panel 58 which is releasably connected to the right front yoke segment 29 by a conventional open-end type zipper 52. The zipper 52 has a first part 54 whose tape is secured to one of the front yoke segments, and a second part 56 which is secured, such as by sewing, to the mounting panel 58. The mounting panel 58 has a patch of hook and loop fastener 60 with portions which protrude inwardly towards the vest front panel, for secure engagement thereto. The mounting panel 58 thus secures the front of the sleeve assembly 20 to the front of the vest 38, yet a user may readily break the connection by operating the zipper 52 or by separating the hook and loop fastener. A similar rear attachment assembly 62 is located on the rear of the sleeve assembly 20, and also has a zipper 64 one part of which is sewn to the rear yoke 26, and the other zipper part of which 66 is sewn to a rear mounting panel 68. The rear mounting panel also has a patch of hook and loop fastener material 70 which mates with a receptive patch of hook and loop fastener material facing outwardly from the rear panel of the vest 38.

Figure 3:
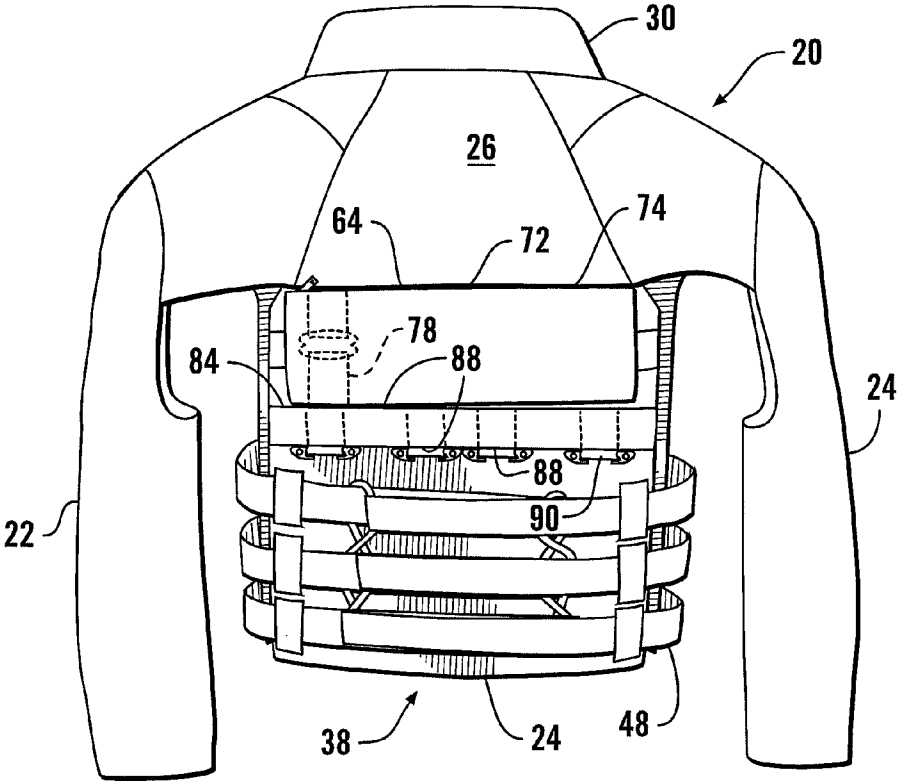
FIG. 3 is a rear elevational view of the sleeve module of FIG. 2 attached to a vest.
Figure 2:
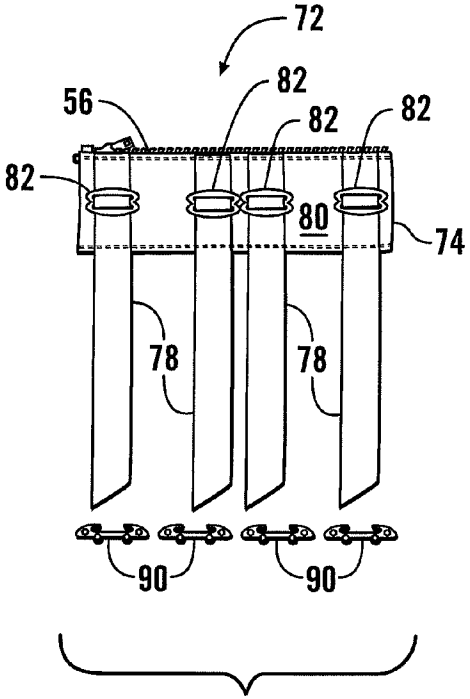
FIG. 2 is an exploded rear view of an attachment assembly for an alternative embodiment sleeve module of this invention.

The zippers 52, 64, allow a single sleeve assembly 20 to be used with a variety of vests by switching out different attachment assemblies. An alternative attachment assembly 72 is shown in FIGS. 2 and 3, and is preferably used on the front and the rear of the vest 38. The rear attachment assembly 72, as shown in FIG. 3, has a mounting panel 74 which extends downwardly from the sleeve assembly with the second half 56 of the zipper 52 sewn along its upper margin, as shown in FIG. 2, showing the frontwardly facing surface of the rear attachment assembly. Multiple webbing straps 78 are sewn to the frontwardly facing surface 80 of the mounting panel 74 along the upper and lower margins of the mounting panel. Each strap 78 has a buckle 82 threaded thereon before it is sewn to the mounting panel. Each strap 78 extends downwardly below the lower margin of the mounting panel 74.

Figure 4:
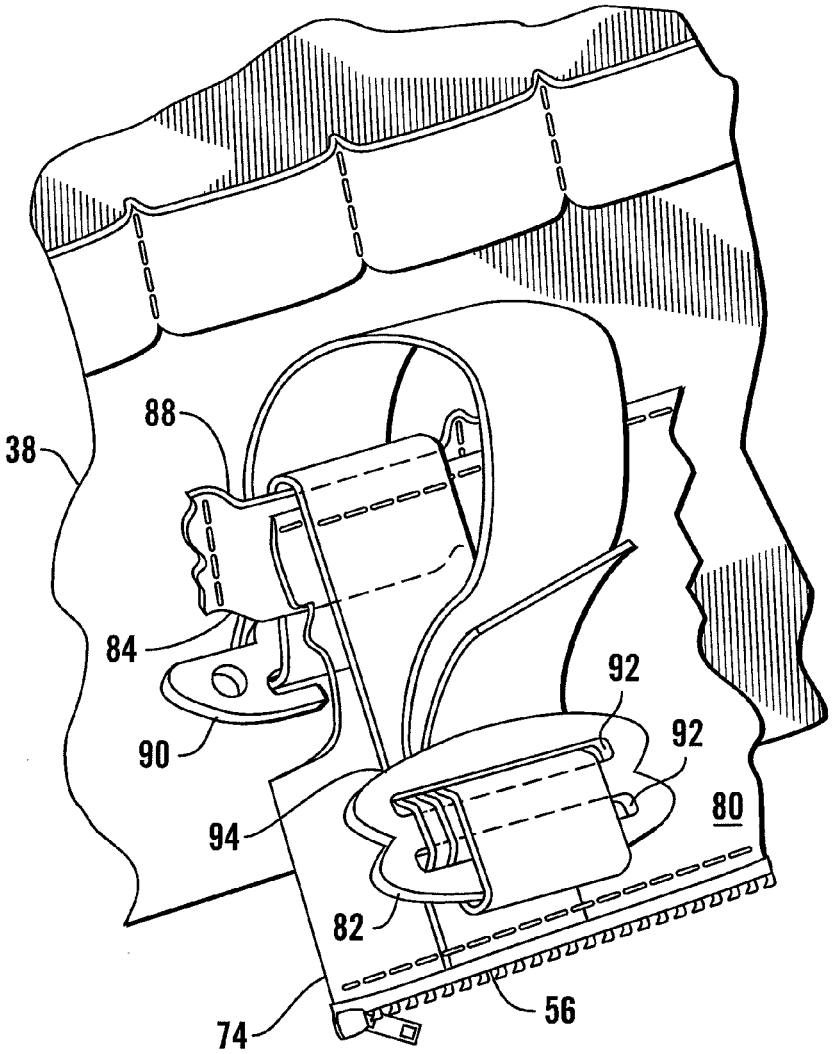
FIG. 4 is a fragmentary schematic view of the attachment assembly of FIG. 2 in relation to a vest to which it is attached.

The straps 78 allow the mounting panel to be securely connected to a conventional webbing strip 84, as shown in FIG. 3. The row of webbing 84 has vertical seams at regular intervals to define an array of sidewardly spaced loops 88 which each open upwardly and downwardly. As shown in FIG. 4, each strap 78 extends downwardly from the mounting panel 74 to pass through a loop 88 and around a C-shaped retaining element 90 which is positioned beneath the horizontal webbing strip loop 88. The strap 78 turns around the retaining element 90 capturing it in a loop, and then extends back up through the same loop 88 and thence through the two openings 92 in the buckle 82, out past the top of the buckle, and then down beneath the lower member 94 of the buckle to thereby lock the mounting panel in the desired location on the rear of the vest. A similar attachment assembly is provided on the front of the sleeve assembly 20 and the vest. The two attachment assemblies retain the sleeve assembly in engagement with the ballistic vest. The strap 78 is exaggerated in length in FIG. 4 to better illustrate the strap path.

It is understood that the invention is not limited to the particular construction and arrangement of parts herein illustrated and described, but embraces all such modified forms thereof as come within the scope of the following claims.

We claim:

1. A ballistic protection garment assembly, comprising:

a first sleeve, the sleeve having a pocket to retain associated with the first sleeve a ballistic element resistant to the penetration of bullets or shrapnel;

a second sleeve;

a front segment extending from at least the first sleeve, and releasably fastenable to the second sleeve to retain the garment on a wearer;

a rear segment extending between and connecting the first sleeve to the second sleeve; and an attachment assembly connected to at least one of the front or rear segments, wherein the attachment assembly is designed to engage elements of a ballistic vest to retain the ballistic protection garment assembly in engagement with the ballistic vest, wherein the attachment assembly has a mounting panel and wherein the mounting panel has structure which protrudes inwardly to engage elements of the ballistic vest.

2. The assembly of claim 1 wherein the mounting panel is releasably connected by a zipper to the front segment or the rear segment.

3. The assembly of claim 1 wherein the inwardly protruding structure on the mounting panel comprises a patch of hook material or of loop material forming one part of a hook and loop fastener, for engagement with a mating loop material or hook material patch attached to the ballistic vest.

4. The assembly of claim 1 wherein the inwardly protruding structure on the mounting panel comprises:

a first strap; and a buckle mounted to the first strap, wherein the first strap is sufficiently long to extend through a loop formed by a horizontal webbing strip fixed to the ballistic vest and return through the buckle.

5. The assembly of claim 4 further comprising a C-shaped retaining element positioned beneath said horizontal webbing strip pocket and engaged within a loop of the first strap.

6. A ballistic protection garment assembly, comprising:

a first sleeve, the sleeve having a pocket to retain associated with the first sleeve a ballistic element resistant to the penetration of bullets or shrapnel;

a second sleeve;

a front segment extending from at least the first sleeve;

a rear segment extending between and connecting the first sleeve to the second sleeve;

a front attachment assembly having a front mounting panel releasably connected by a front zipper to the front segment; and a rear attachment assembly having a rear mounting panel releasably connected by a rear zipper to the rear segment, wherein the front mounting panel and the rear mounting panel have structure which protrudes inwardly to engage elements of a ballistic vest to retain the ballistic protection garment assembly in engagement with the ballistic vest.

7. The assembly of claim 6 wherein the structure on the front mounting panel or the rear mounting panel comprises a patch of hook material or of loop material forming one part of a hook and loop fastener, for engagement with a mating loop material or hook material patch attached to the ballistic vest.

8. The assembly of claim 6 wherein the structure on the front mounting panel or the rear mounting panel comprises:

a first strap; and a buckle mounted to the first strap, wherein the first strap is sufficiently long to extend through a loop formed by a horizontal webbing strip fixed to the ballistic vest and return through the buckle.

9. The assembly of claim 8 further comprising a C-shaped retaining element positioned beneath said horizontal webbing strip pocket and engaged within a loop of the first strap.

10. A ballistic protection garment assembly, comprising:

a first sleeve, the sleeve having a pocket to retain associated with the first sleeve a ballistic element resistant to the penetration of bullets or shrapnel;

a second sleeve;

a front segment extending from at least the first sleeve;

a rear segment extending between and connecting the first sleeve to the second sleeve;

a front attachment assembly having a front mounting panel connected to the front segment;

a first strap fixed to the front mounting panel;

a buckle mounted to the first strap, wherein the first strap is sufficiently long to extend through a loop formed by a horizontal webbing strip fixed to a ballistic vest and return through the buckle; and a rear attachment assembly having a rear mounting panel connected to the rear segment, wherein the front mounting panel and the rear mounting panel engage elements of a ballistic vest to retain the ballistic protection garment assembly in engagement with the ballistic vest.

11. The assembly of claim 10 further comprising a C-shaped retaining element positioned beneath said horizontal webbing strip loop and engaged within a loop of the first strap.

* * * * *